US006122607A

United States Patent [19]

Ekudden et al.

[11] Patent Number: 6,122,607

[45] **Date of Patent: *Sep. 19, 2000**

[54] METHOD AND ARRANGEMENT FOR RECONSTRUCTION OF A RECEIVED SPEECH SIGNAL

[75] Inventors: Erik Ekudden, Stockholm; Daniel Brighenti, Kista, both of Sweden

[73] Assignee: Telefonaktiebolaget LM Ericsson, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,798

[22] Filed: Mar. 25, 1997

[30] Foreign Application Priority Data

Apr. 10, 1996 [SE] Sweden ..... 9601351

[51] Int. Cl.[7] ..... G10L 19/12

[52] U.S. Cl. ..... 704/212; 704/219

[58] Field of Search ..... 704/212, 219, 704/221, 222, 223, 200, 229, 230

[56] References Cited

U.S. PATENT DOCUMENTS

| | | | |
|---|---|---|---|
| 4,831,624 | 5/1989 | McLaughlin et al. | 371/37.07 |
| 5,226,108 | 7/1993 | Hardwick et al. | 395/2.09 |
| 5,233,660 | 8/1993 | Chen | 704/208 |
| 5,432,778 | 7/1995 | Minde et al. | 370/347 |
| 5,502,713 | 3/1996 | Lagerqvist et al. | 370/252 |
| 5,732,356 | 3/1998 | Bolt | 455/462 |
| 5,742,733 | 4/1998 | Jariven | 704/220 |
| 5,778,338 | 7/1998 | Jacobs et al. | 704/223 |
| 5,848,384 | 12/1998 | Hollier et al. | 704/231 |

FOREIGN PATENT DOCUMENTS 0 647 038 5/1995 European Pat. Off. ..... H04B 7/00

OTHER PUBLICATIONS

IEEE International Conference on Acoustics, Speech and Signal Processing. ICASSP 84. Myers et al., "Knowledge Based Speech Analysis and Enhancement", pp. 39A4–1–4.4, vol. 3, Mar. 1984.

(List continued on next page.)

*Primary Examiner*—Richemond Dorvil
*Attorney, Agent, or Firm*—Burns, Doane, Swecker & Mathis, L.L.P.

[57] ABSTRACT

The present invention relates to a method and an arrangement for reconstruction of a received speech signal (r), which has been transmitted over a radio channel that has been subjected to disturbances, such as, e.g., noise, interference or fading. A speech signal ($r_{rec}$), where the effects from these disturbances are minimized, is generated by an estimated speech signal ($\hat{r}$), corresponding to expected future values of the received speech signal (r), produced according to a linear predictive reconstruction model in a signal modelling circuit. The received speech signal (r) and the estimated speech signal ($\hat{r}$) are combined in a signal combination circuit according to a variable ratio, which ratio is determined by a quality parameter (q). The quality parameter (q) may be based on measured power level of a received power level of the desired ratio signal in proportion to an interfering radio signal or a bit error rate signal or bad frame indicator, which has been calculated from data signal that has been transmitted via a certain radio channel and which represents the received speech signal.

43 Claims, 9 Drawing Sheets

OTHER PUBLICATIONS

Bor–Sen Chen et al., *Multirate Modeling of AR/MA Stochastic Signals and Its Application to the Combined Estimation–Interpolation Problem*, Oct. 1995, IEEE Transactions Signal Processing, vol. 43, No. 10.

Cory Myers et al., *Knowledge Based Speech Analysis and Enhancement*, 1984, IEEE International Conference on Acoustics, Speech and Signal Process, San Diego, pp. 39A.4.1–4.4, Mar. 1984.

Mei Yong, *Study of Voice Packet Reconstruction Methods Applied to CELP Speech Coding*, 1992, IEEE, II–125–128, Mar. 1992.

David J. Goodman et al., Waveform Substitution Techniques for Recovering Missing Speech Segments in Packet Voice Communications, IEEE Transactions on Acoustics, Spec, and Signal Processing, vol. ASSP–34, No. 6, Dec. 1986, 1440–1447.

Masanobu Suzuki et al., A Voice Transmission Quality Improvement Scheme for Personal Communication Systems, IEEE, 0–7803–2955, Apr. 1995, 713–717.

CCITT Recommendation G. 728, Coding of Speech at 16 kbit/s Using Low–Delay Code Excited Linear Prediction, Sep. 1992, 1–24.

ETSI SMG2 Speech Expert Group Draft Standard GSM 06.61, Substitution and Muting of Lost Frames Full Rate Speech Traffice Channel, Jan. 1996, 1–7.

ITU–T Study Grup 15 Contribution Draft Annex I on G.728, Decoder Modifications for Frame Erasure Concealment, Feb. 1995, 1–6.

METHOD AND ARRANGEMENT FOR RECONSTRUCTION OF A RECEIVED SPEECH SIGNAL

FIELD OF INVENTION

The present invention relates to a method of reconstructing a speech signal that has been transmitted over a radio channel. The radio channel transmits either fully analogous speech information or digitally encoded speech information. In the latter case, however, the speech information is not speech encoded with linear predictive coding; in other words, it is not assumed that the speech information has been processed in a linear predictive speech encoder on the transmitter side. More specifically, the invention relates to a method for recreating from a received speech signal that may have been subjected to disturbances, such as noise, interference or fading, a speech signal in which the effects of these disturbances have been minimized.

The invention also relates to an arrangement for carrying out the method.

DESCRIPTION OF THE BACKGROUND ART

It is known in the transmission of digitalized speech information from a transmitter to a receiver to encode and decode on the transmitter side and to decode the speech information on the receiver side in accordance with a linear predictive method. LPC (LPC=Linear Predictive Coding) is an energy-related method of analyzing speech information, that enables good speech quality to be achieved at low bit rates. Linear predictive coding, LPC, generates reliable estimates of speech parameters while being relatively effective calculatively at the same time. The GSM EFR (GSM=Global System for Mobile communication; EFR=Enhanced Full Rate), standards, which improved speech encoding for full rate, constitute an example of linear predictive coding, LPC. This coding enables the receiver of a speech signal, which may have been transmitted by radio for instance, to correct certain types of errors that have occurred in the transmission and to conceal other types of error. The methods of frame substitution and error muting or suppression are described in Draft GSM EFR 06.61, "Substitution and muting of lost frames for enhanced full rate speech traffic channels", ETSI, 1996, and ITU Study Group 15 contribution to question 5/15, "G.728 Decoder Modifications for Frame Erasure Concealment", AT&T, February 1995, based on the standard G.728, "Coding of speech at 16 kbps using Low Delay—Code Excited Linear Prediction (LD-CELP)", ITU, Geneva, 1992 can which are examples of procedures of this kind. For instance, U.S. Pat. No. 5,233,660 teaches a digital speech encoder and speech decoder that operate in accordance with the LD-CELP principle.

Because speech information can be encoded in accordance with alternative coding algorithms, such as pulse code modulation, PCM, for instance, it is known to repeat a preceding data word when an error occurs in a given data word. The article "Waveform Substitution Techniques for Recovering Missing Speech Segments in Packet Voice Communications", IEEE Transactions on Acoustics, Speech and Signal Processing, Vol. ASSP-34, No. 6, December 1986, pp. 1440–1447 by David J. Goodman et al, describes how speech information that has been lost in a PCM transmission between a transmitter and a receiver is replaced on the receiver side with information that has been extracted from earlier received information.

In the case of systems in which speech information is modulated in accordance with adaptive differential pulse code modulation, ADPCM, several methods are known for suppressing errors and restricting high signal amplitudes, wherein the state in decoding filters is modified. M. Suzuki and S. Kubota describe in the article, "A Voice Transmission Quality Improvement Scheme for Personal Communication Systems—Super Mute Scheme", NTT Wireless Systems Laboratories, Vol. 4, 1995, pp. 713–717, a method of damping the received signal in the ADPCM transmission of speech information when data has been transmitted erroneously.

SUMMARY OF THE INVENTION

The present invention provides a solution to those problems that are caused in analog radio communications systems and in certain digital cordless telecommunications systems, such as DECT (DECT=Digital European Cordless Telecommunications), in which the radio signal is subjected to disturbances. The clicking sound that occurs when a received analog radio signal becomes too weak and is deluged in noise, for instance due to fading, is an example of one such problem.

The clicking and "bangs" that are generated when repeating a preceding data word in a digitalized speech signal due to registration of an error in the last received data word is an example of another problem.

A further problem concerns the interruption that occurs when a received digitalized speech signal is muted or suppressed because the error rate in the received data words is too high.

Accordingly, an object of the present invention is to create, from a received speech signal that may have been subjected to disturbances during its transmission from a transmitter to a receiver a speech signal wherein the effects of these disturbances is minimized. Such disturbances may have been caused by noise, interference or fading, for instance.

Such objects in accordance with the proposed invention, are achieved by generating from the received speech signal with the aid of signal modelling, an estimated signal which is dependent on a quality parameter that denotes the quality of the received speech signal. The received speech signal and the estimated speech signal are then combined in accordance with a variable relationship which is also determined by the quality parameter, and forms a reconstructed speech signal. When reception conditions cause a change in the speech quality of the received speech signal, the aforesaid relationship is changed and the quality of the reconstructed speech signal restored, thereby obtaining an essentially uniform or constant quality.

A proposed arrangement functions to reconstruct a speech signal from a received speech signal. The arrangement includes a signal modelling unit in which an estimated speech signal corresponding to anticipated future values of the received speech signal are created, and a signal combining unit in which the received signal and the estimated speech signal are combined in accordance with a variable relationship which is determined by a quality parameter.

By reconstructing a received analog or digitalized speech signal, utilizing statistical properties of the speech signal, the speech quality experienced by the receiver can be improved considerably in comparison with the speech quality that it has hitherto been possible to achieve with the aid of the earlier known solutions in analog systems and digital systems that utilize PCM transmission or ADPCM transmission.

Because reconstruction of the received speech signal takes into account the statistical properties of the speech signal, it is also possible to avoid the clicking and banging sound generated in PCM transmissions and ADPCM transmissions for instance, when a preceding data word in the speech signal is repeated due to registration of an error in the data word that was last received.

The interruptions that occur when a received digitalized speech signal is muted because the error rate in the received data word is excessively high can also be avoided by using instead on such occasions solely the estimated speech signal obtained with the proposed invention.

The invention will now be described in more detail with reference to proposed embodiments thereof and also with reference to the accompanying drawings.

DETAILED DESCRIPTION OF PREFERRED EMBODIMENTS

Figure 1:
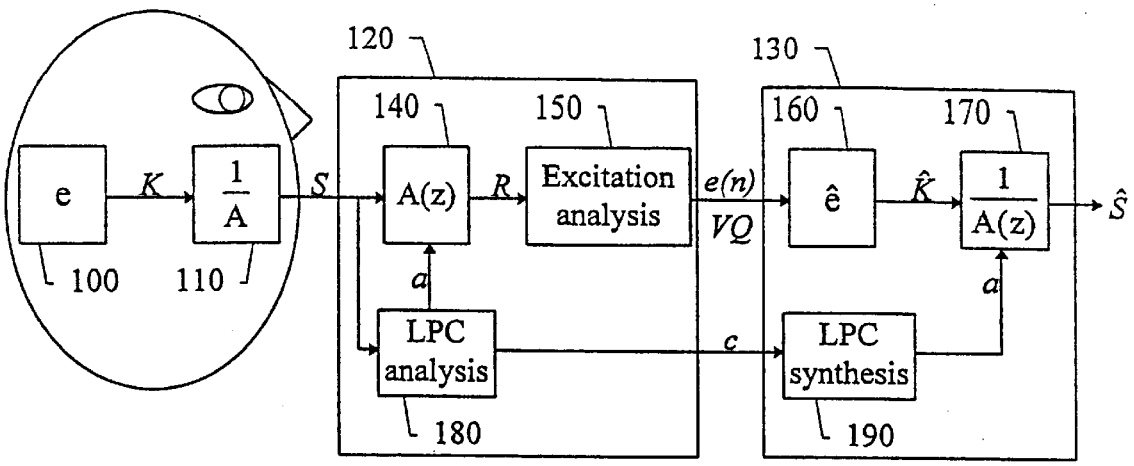
Fig. 1 (PRIOR ART)
FIG. 1 illustrates coding and decoding of speech information with the aid of linear predictive coding (LPC) in a known manner.

FIG. 1 illustrates coding of human speech in the form of speech information S with the aid of linear predictive coding, LPC, in a known manner. The linear predictive coding, LPC, assumes that the speech signal S can conceivably be generated by a tone generator 100 located in a resonance tube 110. The tone generator 100 finds correspondence in the human vocal cords and trachea which together with the oral cavity constitute the resonance tube 110. The tone generator 100 is characterized by intensity and frequency parameters and is designated in this speech model excitation e and is represented by a source signal K. The resonance tube 110 is characterized by its resonance frequencies, the so-called formants, which are described by a short-term spectrum 1/A.

In the linear predictive coding process, LPC, the speech signal S is analyzed in an analyzing unit 120 by estimating and eliminating the underlying short-term spectrum 1/A and by calculating the excitation e of the remaining part of the signal, i.e. the intensity and frequency. Elimination of the short-term spectrum 1/A is effected in a so-called inverse filter 140 having transfer function A(z), which is implemented with the aid of coefficients in a vector a that has been created in an LPC analyzing unit 180 on the basis of the speech signal S. The residual signal, i.e. the inverse filter output signal, is designated residual R. Coefficients e(n) and a side signal c that describes the residual R and short-term spectrum 1/A respectively are transferred to a synthesizer 130. The speech signal $\hat{S}$ is reconstructed in the synthesizer 130 by a process which is the reverse of the process that was used when coding in the analyzing unit 120. The excitation e(n), obtained by analysis in an excitation analyzing unit 150 is used to generate an estimated source signal $\hat{K}$ in an excitation unit 160, $\hat{e}$. The short-term spectrum 1/A, described by the coefficients in the vector A, is created in an LPC-synthesizer 190 with the aid of information from the side signal c. The vector A is then used to create a synthesis filter 170, with transfer function 1/A(z), representing the resonance tube 110 through which the estimated source signal $\hat{K}$ is sent and wherewith the reconstructed speech signal $\hat{S}$ is generated. Because the characteristic of the speech signal $\hat{S}$ varies with time, it is necessary to repeat the aforedescribed process from 30 to 50 times per second in order to achieve acceptable speech quality and good compression.

The basic problem with linear predictive coding, LPC, resides in determining a short-term spectrum 1/A from the speech signal S. The problem is solved with the aid of a differential equation that expresses the sample concerned as a linear combination of preceding samples for each sample of the speech signal S. This is why the method is called linear predictive coding, LPC. The coefficients a in differential equations which describe a short-term spectrum 1/A must be estimated in the linear predictive analysis carried out in the LPC analyzing unit 180. This estimation is made by minimizing the square mean value of the difference $\delta S$ between the actual speech signal S and the predicted speech signal $\hat{S}$. The minimizing problem is solved by the following two steps. There is first calculated a matrix of the coefficient values. An array of linear equations, so-called predictor equations, are then solved in accordance with a method that guarantees convergence and a unique solution.

When generating voiced sounds, a resonance tube 110 is able to represent the trachea and oral cavity, although in the case of nasal sounds the nose forms a lateral cavity which cannot be modelled into the resonance tube 110. However, some parts of these sounds can be captured by the residual R, while remaining parts cannot be transmitted correctly with the aid of simple linear predictive coding, LPC.

Certain consonant sounds are produced by a turbulent air flow which results in a whistling noise. This sound can also be represented in the predictor equations, although the representation will be slightly different because, as distinct from voiced sounds, the sound is not periodic. Consequently, the LPC algorithm must decide with each speech frame whether or not the sound is voiced, which it most often is in the case of vocal sounds, or unvoiced, as in the case of some consonants. If a given sound is judged to be a voiced sound, its frequency and intensity are estimated, whereas if the sound is judged to be unvoiced, only the intensity is estimated. Normally, the frequency is denoted by one digit value and the intensity by another digit value, and information concerning the type of sound concerned is given with the aid of an information bit which, for instance, is set to a logic one when the sound is voiced and to a logic zero when the tone is unvoiced. These data are included in the side signal c generated by the LPC analyzing unit 180. Other information that can be created in the LPC analyzing unit 180 and included in the side signal c are coefficients which denote the short-term prediction, STP, and the long term prediction, LTP, respectively of the speech signal S, the amplification values that relate to earlier transmitted information, information relating to speech sound and non-speech sound respectively, and information as to whether the speech signal is locally stationary or locally transient.

Speech sounds that consist of a combination of voiced and unvoiced sounds cannot be represented adequately by simple linear predictive coding, LPC. Consequently, these sounds will be somewhat erroneously reproduced when reconstructing the speech signal $\hat{S}$.

Errors that unavoidably occur when the short-term spectrum 1/A is determined from the speech signal S result in more information being encoded into the residual R than is necessary theoretically. For instance, the earlier mentioned nasal sounds will be represented by the residual R. In turn, this results in the residual R containing essential information as to how the speech sound shall sound. Linear predictive speech synthesis would give an unsatisfactory result in the absence of this information. Thus, it is necessary to transmit the residual R in order to achieve high speech quality. This is normally effected with the aid of a so-called code book which includes a table covering the most typical residual signals R. When coding, each obtained residual R is compared with all the values present in the code book and the value that lies closest to the calculated value is selected. The receiver has a code book which is identical to the code book used by the transmitter, and consequently only the code VQ that denotes the relevant residual R need be transmitted. Upon receipt of the signal, the residual value R corresponding to the code VQ is taken from the receiver code book and a corresponding synthesis filter 1/A(z) is created. This type of speech transmission is designated code excited linear prediction, CELP. The code book must be large enough to include all essential variants of residuals R while, at the same time, being as small as possible, since this will minimize code book search time and make the actual codes short. By using two small code books of which one is permanent and the other is adaptive enables many codes to be obtained and also enables searches to be carried out quickly. The permanent code book contains a plurality of typical residual values R and can therewith be made relatively small. The adaptive code book is originally empty and is filled progressively with copies of earlier residuals R, which have different delay periods. The adaptive code book will thus function as a shift register and the value of the delay will determine the pitch of the sound generated.

Figure 2:
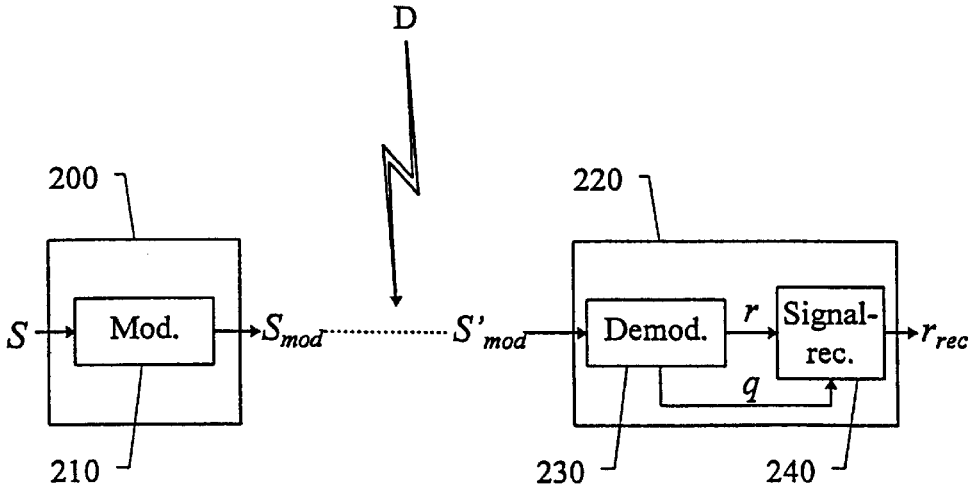
FIG. 2 illustrates in principle how speech information is transmitted, received and reconstructed in accordance with the proposed method.

FIG. 2 shows how speech information S is transmitted, received and reconstructed $r_{rec}$ in accordance with the proposed method. An incoming speech signal S is modulated in a modulating unit 210 in a transmitter 200. A modulated signal $S_{mod}$ is then sent to a receiver 220, over a radio interface, for instance. However, during its transmission the modulated signal $S_{mod}$ will very likely be subjected to different types of disturbances D, such as noise, interference and fading, among other things. The signal $S'_{mod}$ that is received in the receiver 220 will therefore differ from the signal $S_{mod}$ that was transmitted from the transmitter 200. The received signal $S'_{mod}$ is demodulated in a demodulating unit 230, generating a received speech signal r. The demodulating unit 230 also generates a quality parameter q which denotes the quality of the received signal $S'_{mod}$ and indirectly the anticipated speech quality of the received speech signal r. A signal reconstruction unit 240 generates a reconstructed speech signal $r_{rec}$ of essentially uniform or constant quality, on the basis of the received speech signal r and the quality parameter q.

The modulated signal $S_{mod}$ may be a radio frequency modulated signal, which is either completely analog modulated with frequency modulation, FM, for instance, or is digitally modulated in accordance with one of FSK (FSK=Frequency Shift Keying), PSK (PSK=Phase Shift Keying), MSK (MSK=Minimum Shift Keying) or the like. The transmitter and the receiver may be included in both a mobile station and a base station.

Figure 3:
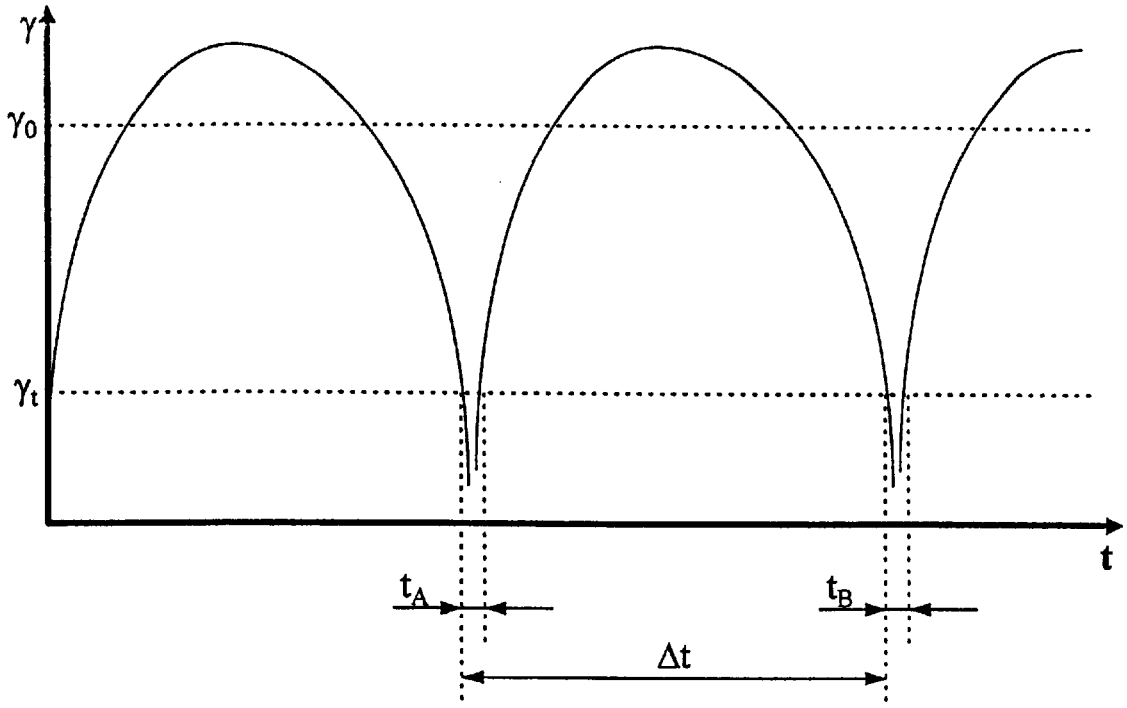
FIG. 3 illustrates an example of a channel model that can be used with the inventive method.

The disturbances D to which a radio channel is subjected often derive from multi-path propagation of the radio signal. As a result of multi-path propagation, the signal strength will, at a given point, be comprised of the sum of two or more radio beams that have travelled different distances from the transmitter and are time-shifted in relation to one another. The radio beams may be added constructively or destructively, depending on the time shift. The radio signal is amplified in the case of constructive addition and weakened in the case of destructive addition, the signal being totally extinguished in the worst case. The channel model that describes this type of radio environment is called the Rayleigh model and is illustrated in FIG. 3. Signal strength $\gamma$ is given in a logarithmic scale along the vertical axis of the diagram, while time t is given in a linear scale along the horizontal axis. The value $\gamma_0$ denotes the long-term mean value of the signal strength $\gamma$, and $\gamma_t$ denotes the signal level at which the signal strength $\gamma$ is so low as to result in disturbance of the transferred speech signal. During respective time intervals $t_A$ and $t_B$, the receiver is located at a point where two or more radio beams are added destructively and the radio signal is subjected to a so-called fading dip. It is, during these time intervals, inter alia, that the use of an estimated version of the received speech signal is applicable in the reconstruction of the signal in accordance with the inventive method. If the receiver moves at a constant speed through a static radio environment, the distance $\Delta t$ between two immediately adjacent fading dips $t_A$ and $t_B$ will be generally constant and $t_A$ will be of the same order of magnitude as t. Both $\Delta t$ and $t_A$ and $t_B$ are dependent on the speed of the receiver and the wavelength of the radio signal. The distance between two fading dips is normally one-half wavelength, i.e. about 17 centimeters at a carrier frequency of 900 Mhz. When the receiver moves at a speed of 1 m/s, At will be roughly equal to 0.17 seconds and a fading dip will seldomly have a duration of more than 20 milliseconds.

Figure 4:
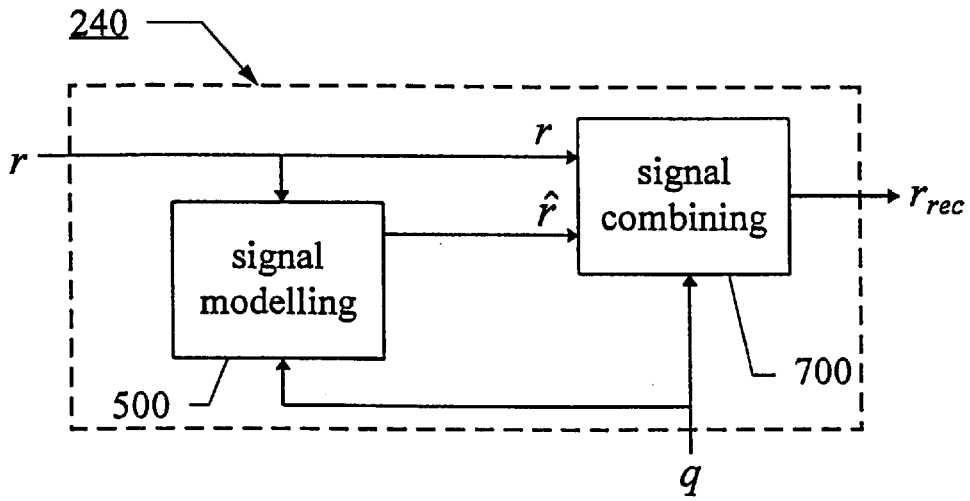
FIG. 4 is a block schematic illustrating the signal reconstruction unit in FIG. 2.

FIG. 4 illustrates generally how the signal reconstruction unit 240 in FIG. 2 generates a reconstructed speech signal $r_{rec}$ in accordance with the proposed method. A received speech signal r is taken into a signal modelling unit 500, in which an estimated speech signal $\hat{r}$ is generated. The received speech signal r and the estimated speech signal $\hat{r}$ are received by a single signal combining unit 700 in which the signals r and r̂ are combined in accordance with a variable ratio. The ratio according to which the combination is effected is decided by a quality parameter q, which is also taken into the signal combining unit 700. The quality parameter q is also used by the signal modelling unit 500, where it controls the method in which the estimated speech signal r̂ is generated. The quality parameter q may be based on the measured received signal strength, RSS, an estimate of the signal level of the desired radio signal C (C=Carrier) at the ratio C/I to the signal level of a disturbance signal I (I=Interferer) or a bit error rate signal or bad frame signal created from the received radio signal. The reconstructed speech signal $r_{rec}$ is delivered from the signal combining unit 700 as the sum of a weighted value of the received speech signal r and a weighted value of the estimated speech signal r̂ where the respective weights for r and r̂ can be varied so as to enable the reconstructed speech signal $r_{rec}$ to be comprised totally of either one of the signals r or r̂.

Figure 5:
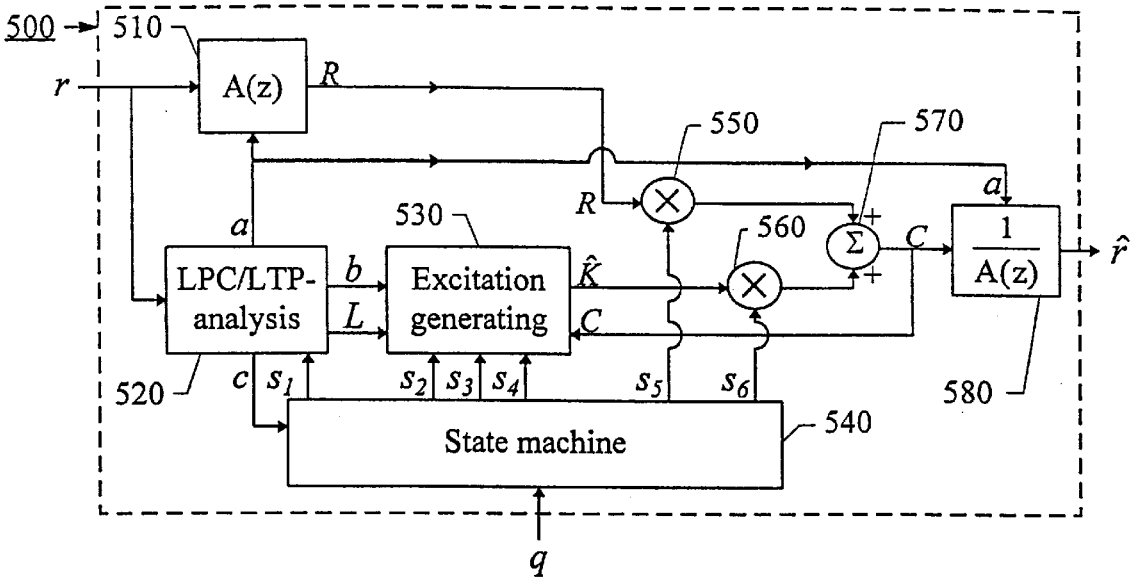
FIG. 5 is a block schematic illustrating the proposed signal modelling unit in FIG. 4.

FIG. 5 is a block schematic illustrating the signal modelling unit 500 in FIG. 4. The received speech signal r is taken into an inverse filter 510, in which the signal r is inversely filtered in accordance with a transfer function A(z), wherein the short-term spectrum 1/A is eliminated and the residual R is generated. Inverse filter coefficients a are generated in an LPC/LTP analyzing unit 520 on the basis of the received speech signal r. The filter coefficients a are also delivered to a synthesis filter 580 with transfer function 1/A(z). The LPC/LTP analyzing unit 520 analyses the received speech signal r and generates a side signal c and the values b and L which denote characteristics of the signal r, and constitute control parameters of an excitation generating unit 530 respectively. The side signal c includes information relating to short-term prediction, STP, and long term prediction, LTP, of the signal r, appropriate amplification values for the control parameter B, information relating to speech sound and non-speech sound, and information relating to whether the signal r is locally stationary or transient, which are delivered to a state machine 540 while the values b and L are sent to the excitation generating unit 530, in which an estimated source signal K̂ is generated.

The LPC/LTP analyzing unit 520 and the excitation generating unit 530 are controlled by the state machine 540 through control signals $s_1$ and $s_2$, $s_3$ and $s_4$, the output signals $s_1$–$s_6$ of the state machine 540 being dependent on the quality parameter q and the side signal c. The quality parameter q generally controls the LPC/LTP analyzing unit 520 and the excitation generating unit 530 through the medium of the control signals $s_1$–$s_4$ in a manner such that the long term prediction, LTP, of the signal r will not be updated if the quality of the received signal r is below a specific value, and such that the amplitude of the estimated source signal K̂ is proportional to the quality of the signal r. The state machine 540 also delivers weighting factors $s_5$ and $s_6$ to respective multipliers 550 and 560, in which the residual R and the estimated source signal K̂ are weighted before being summated in a summating unit 570.

The quality parameter q controls, through the state machine 540 and the weighting factors $s_5$ and $s_6$, the ratio according to which the residual R and the estimated source signal K̂ shall be combined in the summating unit 570 and form a summation signal C, such that the higher the quality of the received speech signal r, the greater the weighting factor $s_5$ for the residual R and the smaller the weighting factor $s_6$ for the estimated source signal K̂. The weighting factor $s_5$ is reduced with decreasing quality of the received speech signal r and the weighting factor $s_6$ increased to a corresponding degree, so that the sum of $s_5$ and $s_6$ will always be constant. The summation signal C, where $C=s_5R+s_6\hat{K}$ is filtered in the synthesis filter 580, there by forming the estimated speech signal r̂. The signal C is also returned to the excitation generating unit 530, in which it is stored to represent historic excitation values.

Since the inverse filter 510 and the synthesis filter 580 have intrinsic memory properties, it is beneficial not to update the coefficients of these filters in accordance with properties of the received speech signal r during those periods when the quality of this signal is excessively low. Such updating would probably result in non-optimal setting of the filter parameters a, which in turn would result in an estimated signal R of low quality, even some time after the quality of the received speech signal r has assumed a higher level. Consequently, in accordance with a refined variant of the invention, the state machine 540 creates the weighted values of the received speech signal r and the estimated speech signal r̂ respectively through a seventh and an eighth control signal, these values being summated and utilized in allowing the LPC/LPT analysis to be based on the estimated speech signal r̂ instead of on the received speech signal r when the quality parameter q is below a predetermined value $q_c$, and to allow the LPC/LPT analysis to be based on the received speech signal r when the quality parameter q exceeds the value q. When q is stable above q., the seventh control signal is always set to logic one and the eighth signal to logic zero, whereas when q is stable beneath q,, the seventh control signal is set to logic zero and the eighth signal is set to logic one. During intermediate transmission periods, the state machine 540 allocates values between zero and one to the control signals in relation to the current value of the quality parameter q. The sum of the control signals, however, is always equal to one.

The transfer functions of the inverse filter 510 and the synthesis filter 580 are always an inversion of one another, i.e. A(z) and 1/A(z). According to a simplified embodiment of the invention, the inverse filter 510 is a high-pass filter having fixed filter coefficients a, and the synthesis filter 580 is a low-pass filter based on the same fixed filter coefficients a. In this simplified variant of the invention, the LPC/LTP analyzing unit 520 thus always delivers the same filter coefficients a, irrespective of the appearance of the received speech signal r.

Figure 6:
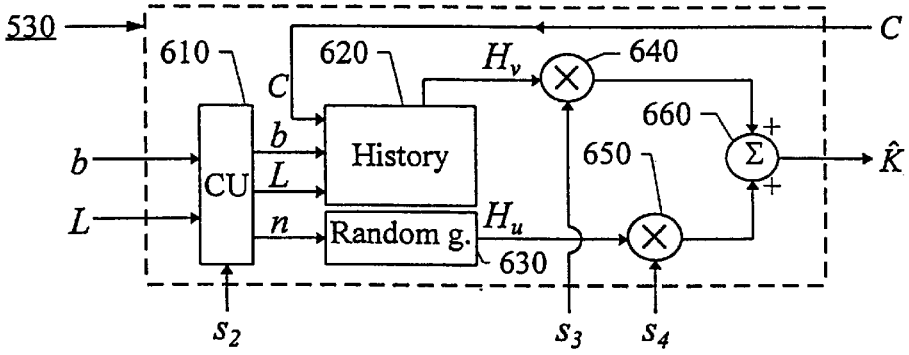
FIG. 6 is a block schematic illustrating the excitation generating unit in FIG. 5.

FIG. 6 is a block schematic illustrating the excitation generating unit in FIG. 5. The values b and L are supplied to the control unit 610, which is controlled by the signal $s_2$ from the state machine 540. The value b denotes a factor by which a given sample ê(n+1) from a memory buffer 620 shall be multiplied, and the value L denotes a shift corresponding to L sample steps backwards in the excitation history, from which a given excitation ê(n) shall be taken. Excitation history ê(n+1), ê(n+2), . . . , ê(n+N) from the signal C is stored in the memory buffer 620. The storage capacity of the memory buffer 620 will correspond to at least 150 samples, i.e. N=150, and information from the signal C is stored in accordance with the shift register principle wherein the oldest information is shifted out, i.e. in this case erased, when new information is shifted in.

When the LPC/LTP analysis judges the sound concerned to be a voiced sound, the control signal $s_2$ gives the control unit 610 the consent to deliver the values b and L to the memory buffer 620. The value L, which is created from the long term prediction, LTP, of the speech signal r, denotes the periodicity of the speech signal r, and the value b constitutes a weighting factor by which a given sample ê(n+i) from the excitation history shall be multiplied in order to provide an estimated source signal $\hat{K}$ which generates an optimal estimated speech signal $\hat{r}$, through the medium of the summation signal C. The values b and L thus control the manner in which information is read from the memory buffer 620 and thereby form a signal $H_v$.

If in the LPC/LTP analysis a current sound is judged to be non-voice, the control signal $s_2$ delivers to the control unit 610 an impulse to send a signal n to a random generator 630, where after the generator generates a random sequence $H_u$.

The signal $H_v$ and the random signal $H_u$ are weighted in multiplication units 640 and 650 with respective factors $s_3$ and $s_4$ and are summated in a summation unit 660, wherein the estimated source signal $\hat{K}$ is generated in accordance with the expression $\hat{K}=s_5H_v+s_6H_u$. If the current speech sound is voice, the factor $s_3$ is set to a logic one and the factor $s_4$ is set to a logic zero, whereas if the current speech sound is non-voice, the factor $s_3$ is set to a logic zero and the factor $s_4$ to a logic one. At a transition from a voice to a non-voice sound, $s_3$ is reduced during a number of mutually sequential samples and $s_4$ is increased to a corresponding degree, whereas in the transition from a non-voice to a voice sound, $s_4$ and $s_3$ are respectively reduced and increased in a corresponding manner.

The summation signal C is delivered to the memory buffer 620 and updates the excitation history $\hat{e}(n)$ sample by sample.

Figure 7:
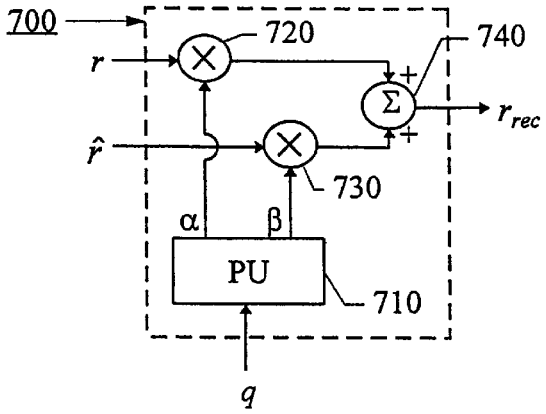
FIG. 7 is a block schematic illustrating the proposed signal combining unit in FIG. 4.

FIG. 7 illustrates the signal combining unit 700 in FIG. 4, in which the received speech signal r and the estimated speech signal $\hat{r}$ are combined. In addition to these signals, the signal combining unit 700 also receives the quality parameter q. On the basis of the quality parameter q, a processor 710 generates weighting factors $\alpha$ and $\beta$ by which the respective received speech signal r and estimated speech signal $\hat{r}$ are multiplied in multiplying units 720 and 730 prior to being added in the summation unit 740, and form the reconstructed speech signal $r_{rec}$. The respective weighting factors $\alpha$ and $\beta$ are varied from sample to sample, depending on the value of the quality parameter q. When the quality of the received speech signal r increases, the weight factor $\alpha$ is increased and the weighting factor $\beta$ decrease to a corresponding extent. The reverse applies when the quality of the received speech signal r falls. However, the sum of $\alpha$ and $\beta$ is always one.

Figure 8:
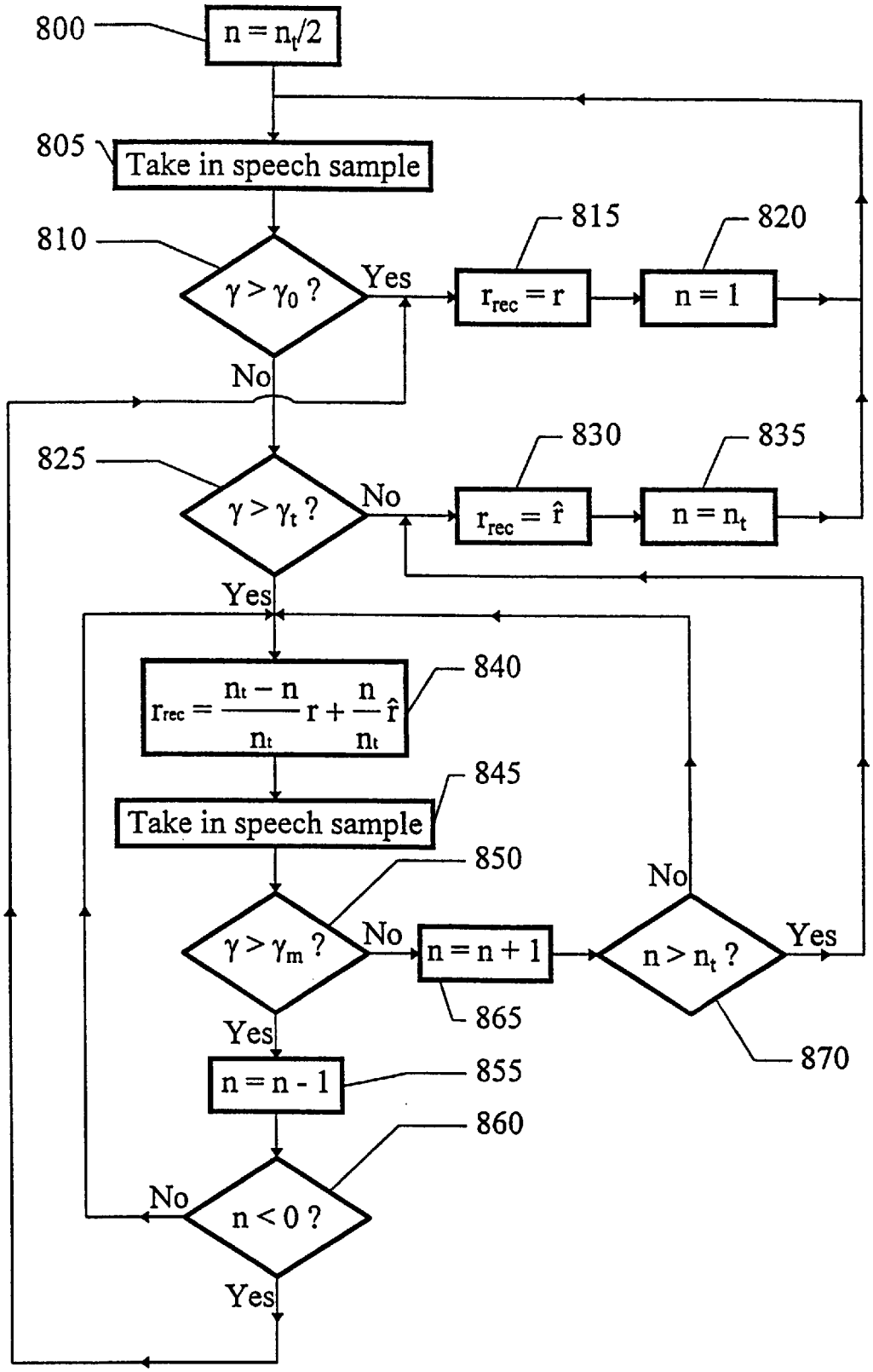
FIG. 8 is a flowchart illustrating a first embodiment of the inventive signal combining method applied in the signal combining unit in FIG. 7.

The flowchart in FIG. 8 illustrates how the received speech signal r and the estimated speech signal $\hat{r}$ are combined in the signal combining unit 700 in FIG. 7 in accordance with a first embodiment of the inventive method. The processor 710 of the signal combining unit 700 includes a counter variable n which can be stepped between the values −1 and $n_t$+1. The value $n_t$ gives the number of consecutive speech samples during which the quality parameter q of the received radio signal can fall beneath or exceed a predetermined quality level $\gamma_m$ before the reconstructed signal $r_{rec}$ will be identical with the estimated speech signal $\hat{r}$ for the received speech signal r respectively, and during which speech samples the reconstructed speech signal $r_{rec}$ will be comprised of a combination of the received speech signal r and the estimated speech signal $\hat{r}$. Thus, the larger the value of $n_t$, the longer the transition period $t_t$ between the two signals r and $\hat{r}$.

In step 800, the counter variable n is given the value $n_t/2$ in order to ensure that the counter variable n will have a reasonable value should the flowchart land in step 840 in the reconstruction of the first speech sample. In step 805, the signal combining unit 700 receives a first speech sample of the received speech signal r. In step 810, it is ascertained whether or not a given quality parameter q exceeds a predetermined value. In this example, the received signal quality is allowed to represent the power level $\gamma$ of the received radio signal. The power level $\gamma$ is compared in step 810 with a power level $\gamma_0$ that comprises the long term mean value of the power level $\gamma$ of the received radio signal. If $\gamma$ is higher than $\gamma_0$, the reconstructed speech signal $r_{rec}$ is made equal to the received speech signal r in step 815, the counter variable n is set to logic one in step 820, and a return is made to step 805 in the flowchart. Otherwise, it is ascertained in step 825 whether or not the power level $\gamma$ is higher than a predetermined level $\gamma_t$, which corresponds to the lower limit of an acceptable speech quality. If $\gamma$ is not higher than $\gamma_t$, the reconstructed speech signal $r_{rec}$ is made equal to the estimated speech signal $\hat{r}$ in step 830, the counter variable n is set to $n_t$ in step 835, and a return is made to step 805 in the flowchart. If it should be found in step 825 that $\gamma$ is higher than $\gamma_t$, the reconstructed speech signal $r_{rec}$ is calculated in step 840 as the sum of a first factor $\alpha$ multiplied by the received speech signal r and a second factor $\beta$ multiplied by the estimated speech signal $\hat{r}$. In this example, $\alpha=(n_t-n)/n_t$ and $n/n_t$, and hence $r_{rec}$ is given by the expression $r_{rec}=(n_t-n)\times r/n_t+n\times\hat{r}/n_t$. The next speech sample of the received speech signal is taken in step 845, and it is ascertained in step 850 whether or not the corresponding power level $\gamma$ of the received radio signal is higher than the level $\gamma_m$, which denotes the arithmetical mean value of $\gamma_0$ and $\gamma_t$, i.e. $\gamma_m=(\gamma_0+\gamma_t)/2$, and if such is the case the counter variable n is counted down one increment in step 855 and it is ascertained in step 860 whether or not the counter variable n is less than zero. If it is found in step 860 that the counter variable n is less than zero, this indicates that the power level $\gamma$ has exceeded the value $\gamma_m$ during n, consecutive samples and that the reconstructive speech signal $r_{rec}$ can therefore be made equal to the received speech signal r. The flowchart is thus followed to step 815. If, in step 860, the counter variable n is found to be greater than or equal to zero, the flowchart is executed to step 840 and a new reconstructed speech signal $r_{rec}$ is calculated. If in step 850 the power level $\gamma$ is lower than or equal to $\gamma_m$, the counter variable n is increased by one in step 865. It is then ascertained in step 870 whether or not the counter variable n is greater than the value $n_t$ and if such is the case this indicates that the signal level $\gamma$ has fallen beneath the value $\gamma_m$ during $n_t$ consecutive samples and that the reconstructed speech signal $r_{rec}$ should therefore be made equal to the estimated speech signal $\hat{r}$. A return is therefore made to step 830 in the flowchart. Otherwise, the flowchart is executed to step 840 and a new reconstructed speech signal $r_{rec}$ is calculated.

Figure 9:
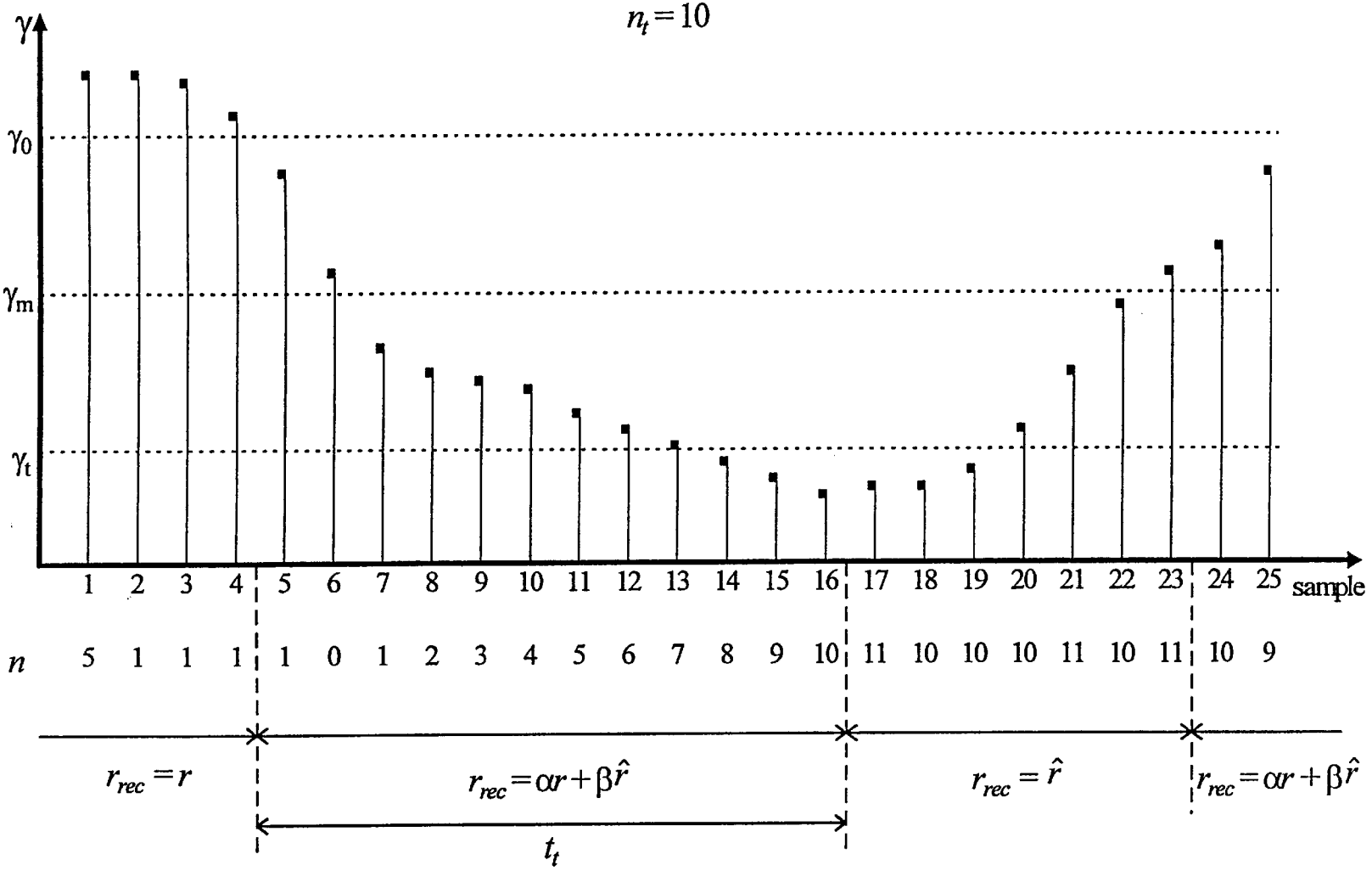
FIG. 9 illustrates an example of a result that can be obtained when following the flowchart in FIG. 8.

FIG. 9 illustrates an example of a result that can be obtained when executing the flowchart in FIG. 8. The variable $n_t$ has been set to 10 in the example. The power level $\gamma$ of the received radio signal exceeds the long-term mean value $\gamma_0$ during the first four received speech samples 1–4. Consequently, because the flowchart in FIG. 8 only runs through steps 800–820, the counter variable n will therefore be equal to one during samples 2–5. Thus, the reconstructed speech signal $r_{rec}$ will be identical with the received speech signal r during samples 1–4. The reconstructed speech signal $r_{rec}$ will be comprised of a combination of the received speech signal r and the estimated speech signal $\hat{r}$ during the following twelve speech samples 5–16, because the power level $\gamma$ of the received radio signal with respect to these speech samples will lie beneath the long-term mean value $\gamma_0$ of the power level of the received radio signal. For instance, the reconstructed speech signal $r_{rec}$ or speech sample 5 will be given by the expression $r_{rec}=0.9r+$ 0.1r̂, because n=1, and for speech sample 14 will be given by the expression $r_{rec}$=0.2r+0.8r̂, because n=8. The reconstructed speech signal $r_{rec}$ will be identical with the estimated speech signal r̂ in the case of speech sample 17–23, since the power level γ of the received radio signal with respect to the ten ($n_t$=10) nearest preceding sample 7–16 has fallen beneath the value $\gamma_m$ and the power level γ of the radio signal with respect to sample 17–22 is lower than the value $\gamma_m$. The reconstructed speech signal $r_{rec}$ will again be comprised of a combination of the received speech signal r and the estimated speech signal r̂ during the terminating two samples 24 and 25, because the power level γ of the received radio signal in respect of speech samples 23 and 24 exceeds the power level $\gamma_m$ but falls beneath the long-term mean value $\gamma_0$. It can be noted by way of example that the reconstructed speech signal $r_{rec}$ for speech sample 25 is given by the expression $r_{rec}$=0.1r+0.9r̂, because n=9.

Figure 10:
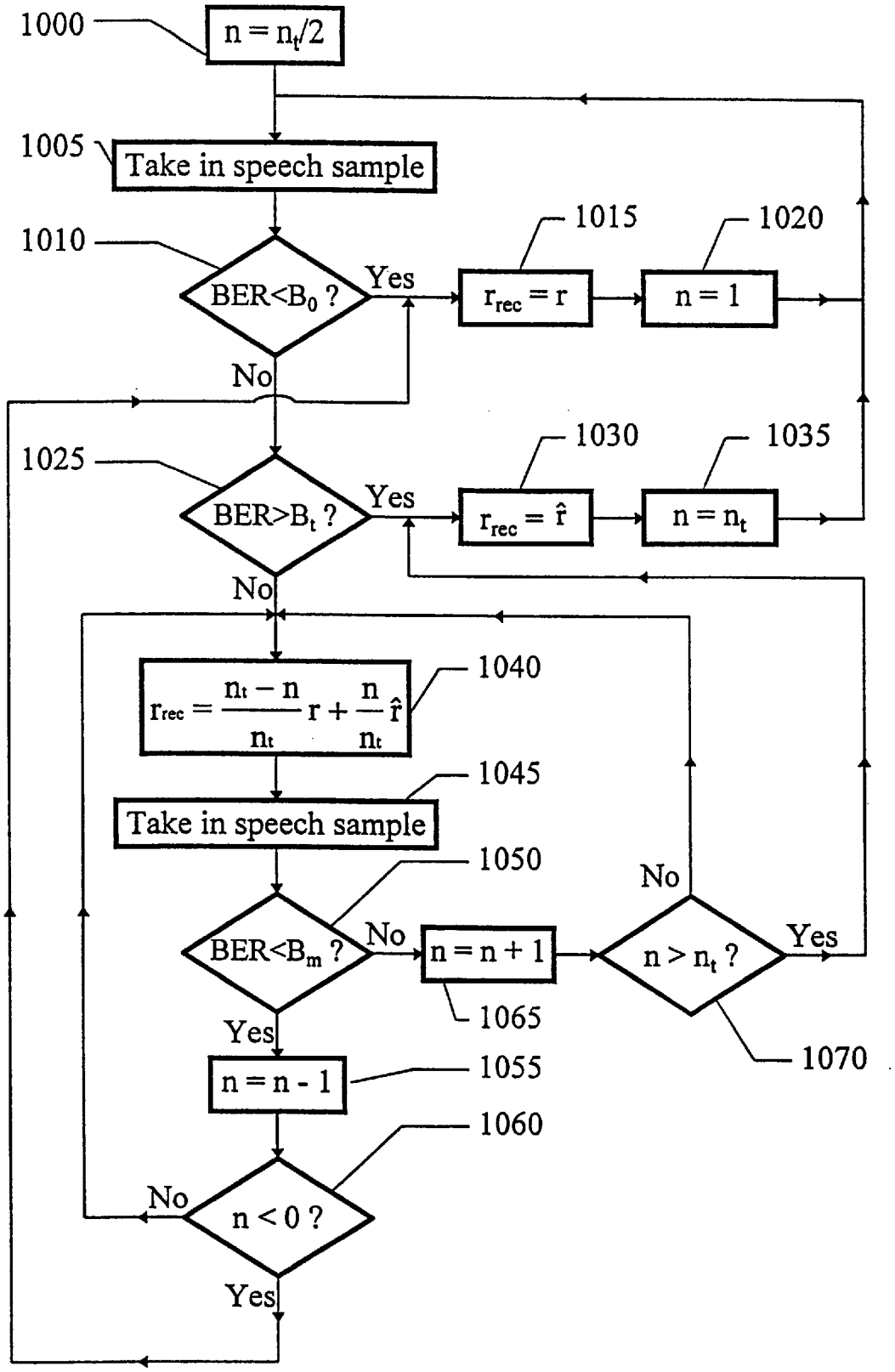
FIG. 10 is a flowchart illustrating a second embodiment of the inventive signal combining method applied in the signal combining unit in FIG. 7.

The flowchart in FIG. 10 shows how the received speech signal r and the estimated speech signal r̂ are combined in the signal combining unit 700 in FIG. 7 in accordance with a second embodiment of the inventive method. A variable n in the processor 710 can also be stepped between the values −1 and $n_t$+1 in this embodiment. The value $n_t$ also in this case denotes the number of consecutive speech samples during which the quality parameter q of the received radio signal may lie beneath or exceed respectively a predetermined quality level $B_m$ before the reconstructed signal $r_{rec}$ is identical with the estimated speech signal r̂ and the received speech signal r respectively, and during which speech samples the reconstructed speech signal $r_{rec}$ is comprised of a combination of the received speech signal r and the estimated speech signal r̂.

The counter variable n is allocated the value $n_t/2$ in step 1000, so as to ensure that the counter variable n will have a reasonable value if step 1040 in the flowchart should be reached when reconstructing the first speech sample. In step 1005, the signal combining unit 700 takes a first speech sample of the received speech signal r. In step 1010, it is ascertained whether or not the quality parameter q, in this example represented by the bit error rate, BER, with respect to a data word corresponding to a given speech sample, exceeds a given value, i.e. whether or not the bit error rate, BER, lies beneath a predetermined value $B_0$. The bit error rate, BER, can be calculated, for instance, by carrying out a parity check on the received data word that represents said speech sample. The value $B_0$ corresponds to a bit error rate, BER, up to which all errors can either be corrected or concealed completely. Thus, $B_0$ will equal 1 in a system in which errors are not corrected and cannot be concealed. The bit error rate, BER, is compared with the level $B_0$ in step 1010. If the bit error rate, BER, is lower than $B_0$, the reconstructed speech signal $r_{rec}$ is made equal to the received speech signal r in step 1015, the counter variable n is set to one in step 1020, and a return is made to step 1005 in the flowchart. Otherwise, it is ascertained in step 1025 whether or not the bit error rate, BER, is higher than a predetermined level $B_t$ that corresponds to the upper limit of an acceptable speech quality. If the bit error rate, BER, is found to be higher than $B_t$, the reconstructed speech signal $r_{rec}$ is made equal to the estimated speech signal r̂ in step 1030, the counter variable n is set to $n_t$ in step 1035, and a return is made to step 1005 in the flowchart. If the bit error rate, BER, is found to be lower than or equal to $B_t$ in step 1025, the reconstructed speech signal $r_{rec}$ is calculated in step 1040 as the sum of a first factor α multiplied by the received speech signal r and a second factor β multiplied by the estimated speech signal r̂. In this example, $\alpha=(n_t-n)/n_t$ and $\beta=n/n_t$, and hence $r_{rec}$ is given by the expression $r_{rec}=(n_t-n)\times r/n_t+n\times \hat{r}/n_t$. The next speech sample of the received speech signal is taken in step 1045 and it is ascertained in step 1050 whether or not a corresponding bit error rate, BER, of the received data signal is lower than a level $B_m$ which, for example, denotes the arithmetical mean value of $B_0$ and $B_t$, i.e. $B_m=(B_0+B_t)/2$, and if such is the case the counter variable n is counted down one increment in step 1055 and it is ascertained in step 1060 whether or not the counter variable n is less than zero. If the counter variable n in step 960 is less than zero, this indicates that the bit error rate, BER, has fallen beneath the value $B_m$ during $n_t$ consecutive speech samples and that the reconstructed speech signal $r_{rec}$ can therefore be made equal to the received speech signal r. The flowchart is thus executed to step 1015. If the counter variable n in step 1060 is greater than or equal to zero, the flowchart is executed to step 1040 and a new reconstructed speech signal $r_{rec}$ is calculated. If the bit error rate, BER, in step 1050 is higher than or equal to $B_m$, the counter variable n is increased by one in step 1065. It is then ascertained in step 1070 whether or not the counter variable n is greater than the value $n_t$. If such is the case, this indicates that the bit error rate, BER, has exceeded the value $B_m$ during $n_t$ consecutive samples and that the reconstructed speech signal $r_{rec}$ should therefore be placed equal with the estimated speech signal r̂. A return is therefore made to step 1030 in the flowchart. Otherwise, the flowchart is executed to step 1040 and a new reconstructed speech signal $r_{rec}$ is calculated.

A special case of the aforedescribed example is obtained when q is allowed to constitute a bad frame indicator, BFI, wherein q can assume two different values, instead of allowing the quality parameter q to denote the bit error rate, BER, for each data word. If the number of errors in a given data word exceeds a predetermined value $B_t$, this is indicated by setting q to a first value, for instance a logic one, and by setting q to a second value, for instance a logic zero, when the number of errors is lower than or equal to $B_t$. A soft transition between the received speech signal r and the estimated speech signal r̂ is obtained in this case by weighting the signals r and r̂ together with respective predetermined weighting factors α and β during a predetermined number of samples $n_t$. For instance, $n_t$ may be four samples during which α and β are stepped through the values 0.75, 0.50, 0.25 and 0.00, and 0.25, 0.50, 0.75 and 1.00 respectively, or vice versa.

Figure 11:
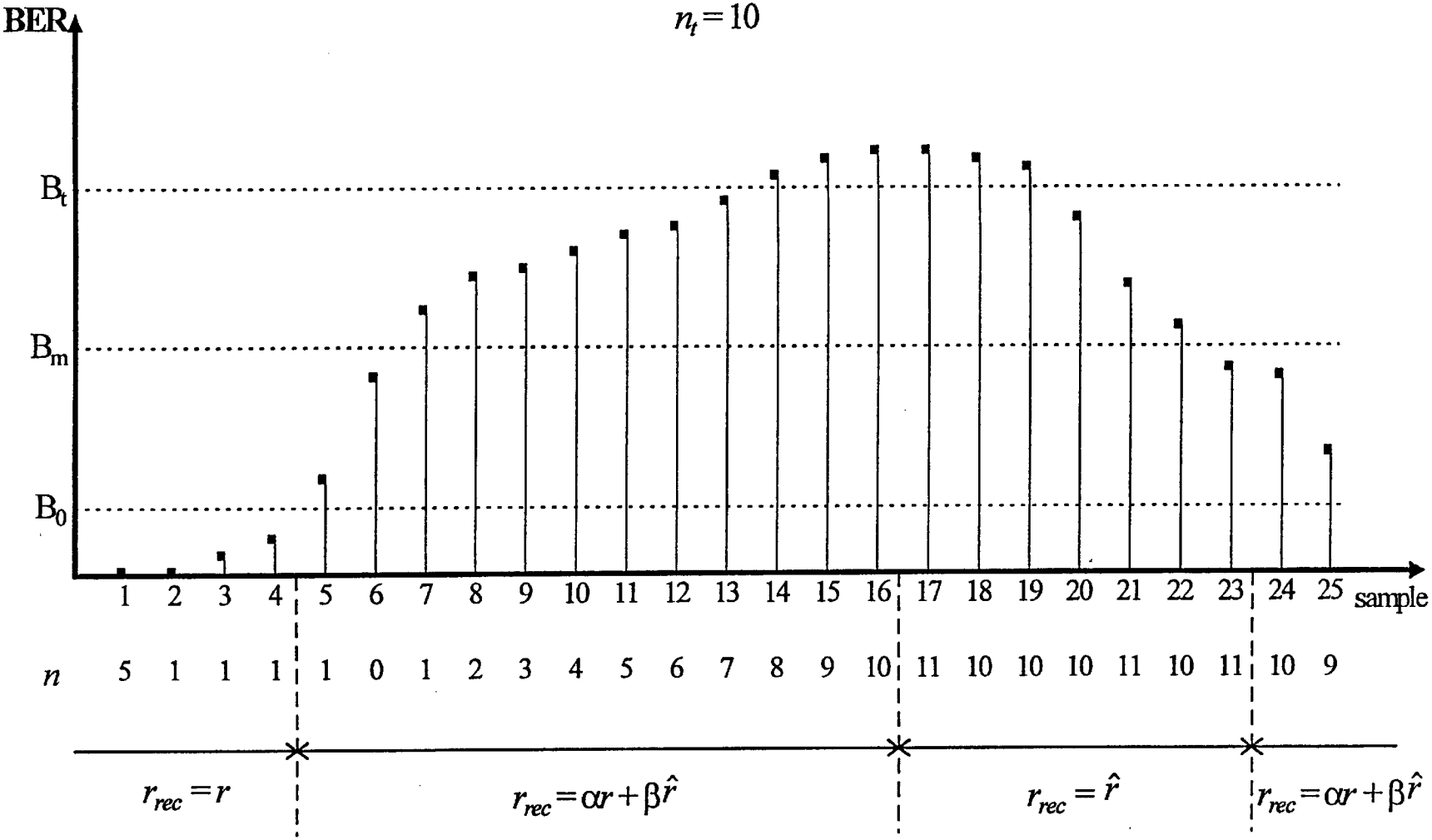
FIG. 11 illustrates an example of a result that can be obtained when following the flowchart in FIG. 10.

FIG. 11 shows an example of a result that can be obtained when running through the flowchart in FIG. 10. The variable $n_t$ has been set to 10 in the example. The bit error rate, BER, of a received data signal is shown along the vertical axis of the diagram in FIG. 11, and samples 1–25 of the received data signal are shown along the horizontal axis of the diagram, the data signal having been transmitted via a radio channel and represents speech information. The bit error rate, BER, is divided into three levels $B_0$, $B_m$ and $B_t$. A first level, $B_0$, corresponds to a bit error rate, BER, which results in a perceptually error-free speech signal. In other words, the system is able to correct and/or conceal up to $B_0$−1 bit errors in each received data word. A second level, $B_t$, denotes a bit error rate, BER, of such high magnitude that corresponding speech signals will have an unacceptably low quality. A third level $B_m$ constitutes the arithmetical mean value $B_m=(B_t+B_0)/2$ of $B_t$ and $B_0$.

The bit error rate, BER, of the received data signal is below the level $B_0$ during the first four speech samples 1–4 received. Consequently, the counter variable n is equal to one during samples 2–5 and the reconstructed speech signal $r_{rec}$ is identical to the received speech signal r. During the following twelve speech samples 5–16, the reconstructed speech signal $r_{rec}$ will be comprised of a combination of the received speech signal r and the estimated speech signal $\hat{r}$, since the bit error rate, BER, of the received data signal with respect to these speech samples will lie above $B_0$. The reconstructed speech signal $r_{rec}$ will be identical to the estimated speech signal $\hat{r}$ in the case of speech samples 17–23, since the bit error rate, BER, of the received data signal with respect to the ten ($n_t$=10) nearest preceding samples 7–16 has exceeded the value $B_m$ and the bit error rate in respect of samples 17–22 is higher than the value $B_m$. The reconstructed speech signal $r_{rec}$ will again be comprised of a combination of the received speech signal r and the estimated speech signal $\hat{r}$ during the two terminating samples 24 and 25, since the bit error rate, BER, of the received data signal with respect to speech samples 23 and 24 is below the level $B_m$, but exceeds the level $B_0$.

In a first and a second embodiment of the invention, the quality parameter q has been based on a measured power level $\gamma$ of the received radio signal and a calculated bit error rate, BER, of a data signal that has been transmitted via a given radio channel and which represents the received speech signal r. Naturally, in a third embodiment of the invention, the quality parameter q can be based on an estimate of the signal level of the desired radio signal C in a ratio C/I to the signal level of a interference signal I. The relationship between the ratio C/I and the reconstructed speech signal $r_{rec}$ will then be essentially similar to the relationship illustrated in FIG. 8, i.e. the factor $\beta$ is increased and the factor $\alpha$ decreased to a corresponding extent in the case of decreasing C/I, and the factor a is increased at the cost of factor $\beta$ in the case of increasing C/I. Corresponding flowcharts will, in principle, correspond to FIG. 8. Step 810 would differ insomuch that instead $C/I>C_0$, step 825 would differ insomuch that $C/I>C_t$ and step 850 would differ insomuch that $C/I>C_m$, but the same conditions will apply in all other respects.

Figure 12:
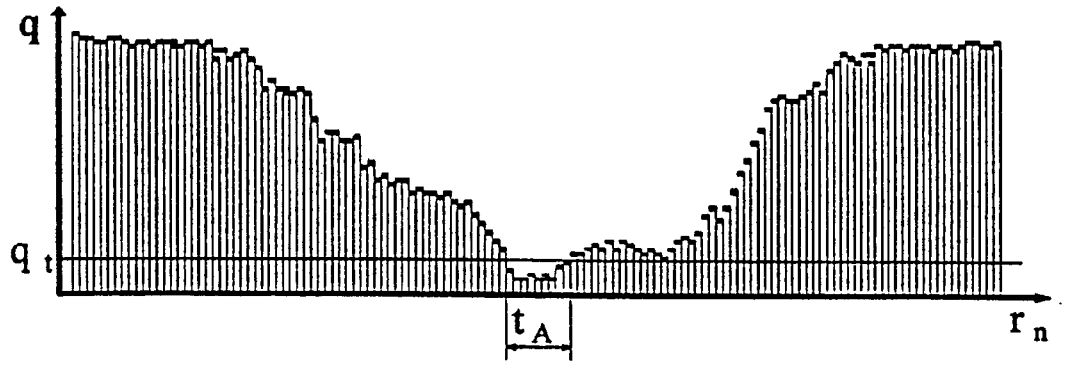
FIG. 12 illustrates an example of how a quality parameter for a received speech signal varies over a sequence of received speech samples.

FIG. 12 illustrates how a quality parameter q for a received speech signal r can vary over a sequence of received speech samples $r_n$. The value of the quality parameter q is shown along the vertical axis of the diagram, and the speech samples $r_n$ are presented along the horizontal axis of the diagram. The quality parameter q for speech sample $r_n$ received during a time interval $t_A$ lies beneath a predetermined level $q_t$ that corresponds to the lower limit for acceptable speech quality. The received speech signal r will therefore be subjected to disturbance during this time interval $t_A$.

Figure 13:
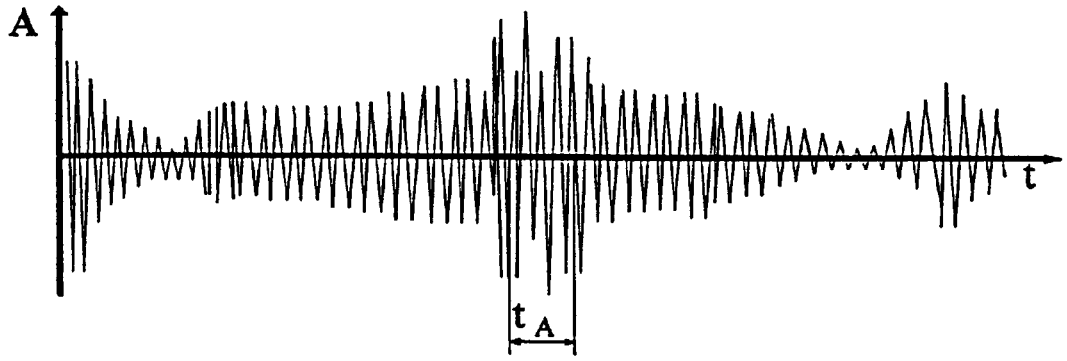
FIG. 13 is a diagram illustrating the signal amplitude of the received speech signal referred to in FIG. 12.

FIG. 13 illustrates how the signal amplitude A of the received speech signal r, referred to in FIG. 12, varies over a time t corresponding to speech samples $r_n$. The signal amplitude A is shown along the vertical axis of the diagram and the time t is presented along the horizontal axis of said diagram. The speech signal r is subjected to disturbance in the form of short discordant noises or crackling/clicking sound, this being represented in the diagram by an elevated signal amplitude A of a non-periodic character.

Figure 14:
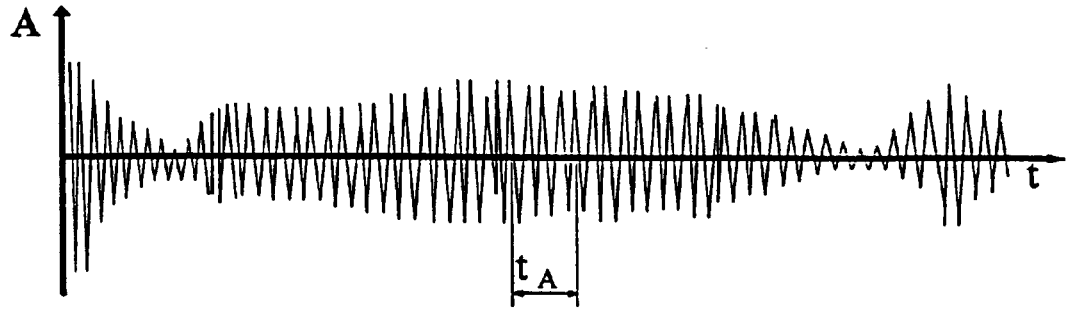
FIG. 14 is a diagram illustrating the signal amplitude of the speech signal shown in FIG. 13, the speech signal having been reconstructed in accordance with the proposed method.

FIG. 14 illustrates how the signal amplitude A varies over a time t corresponding to speech samples $r_n$ of a version $r_{rec}$ of the speech signal r illustrated in FIG. 13 that has been reconstructed in accordance with the inventive method. The signal amplitude A is shown along the vertical axis of the diagram and the time t is presented along the horizontal axis. During the time interval $t_A$, in which the quality parameter q lies beneath the level $q_t$, the reconstructed speech signal will be comprised, either totally or partially, of an estimated speech signal $\hat{r}$ that has been obtained by linear prediction of an earlier received speech signal r whose quality parameter q has exceeded $q_t$. The estimated speech signal $\hat{r}$ is therefore probably of better quality than the received speech signal r. Thus, the reconstructed speech signal $r_{rec}$, which is comprised of a variable combination of the received speech signal r and an estimated version $\hat{r}$ of the speech signal, will have a generally uniform or constant quality irrespective of the quality of the received speech signal r.

Figure 15:
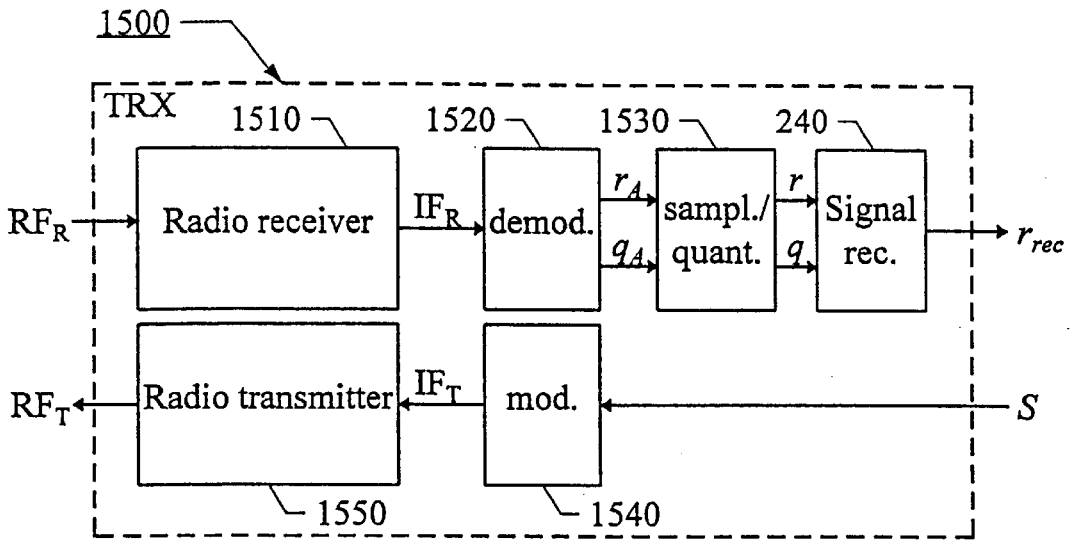
FIG. 15 is a block schematic illustrating application of the inventive signal reconstruction unit in an analog transmitter/receiver unit.

FIG. 15 illustrates the use of the proposed signal reconstruction unit 240 in an analog transmitter/receiver unit 1500, designated TRX, in a base station or in a mobile station. A radio signal $RF_R$ from an antenna unit is received in a radio receiver 1510 which delivers a received intermediate frequency signal $IF_R$. The intermediate frequency signal $IF_R$ is demodulated in a demodulator 1520 and an analog received speech signal $r_A$ and an analog quality parameter $q_A$ are generated. These signals $r_A$ and $q_A$ are sampled and quantized in a sampling and quantizing unit 1530, which delivers corresponding digital signals r and q respectively that are used by the signal reconstruction unit 240 to generate a reconstructed speech signal $r_{rec}$ in accordance with the proposed method.

A transmitted speech signal S is modulated in a modulator 1540 in which an intermediate frequency signal $IF_T$ is generated. The signal $IF_T$ is radio frequency modulated and amplified in a radio transmitter 1550, and a radio signal $RF_T$ is delivered for transmission to an antenna unit.

Figure 16:
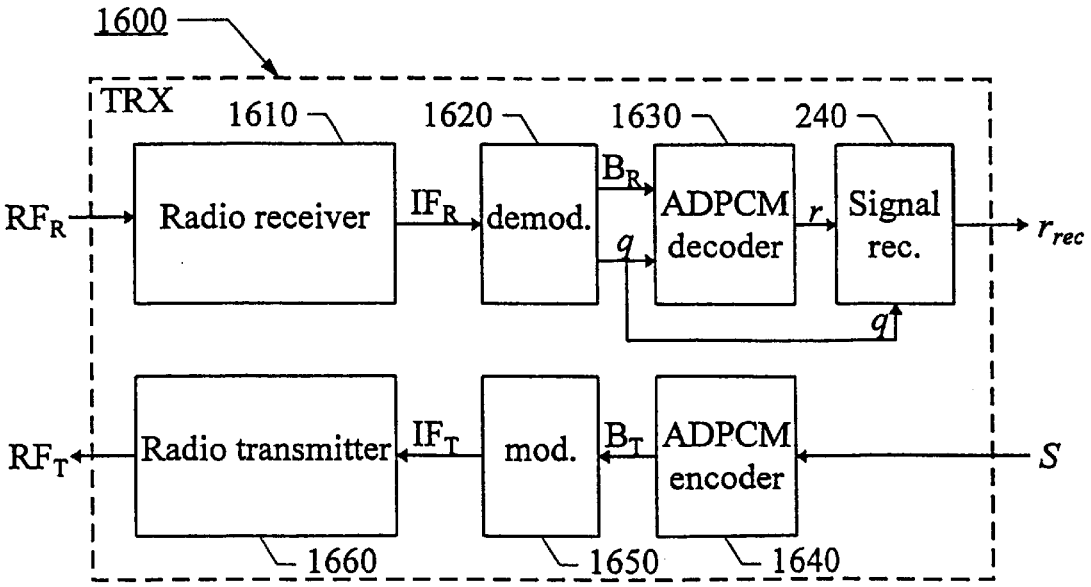
FIG. 16 is a block schematic illustrating the application of the inventive signal reconstruction unit in a transmitter/receiver unit which is intended for transmitting and receiving digitalized speech information.

FIG. 16 illustrates the use of the proposed signal reconstruction unit 240 in a transmitter/receiver unit 1600, designated TRX, in a base station or a mobile station that communicates ADPCM encoded speech information. A radio signal $RF_R$ from an antenna unit is received in a radio receiver 1610 which delivers a received intermediate frequency signal $IF_R$. The intermediate frequency signal $IF_R$ is demodulated in a demodulator 1620 which delivers an ADPCM encoded baseband signal $B_R$ and a quality parameter q. The signal $B_R$ is decoded in an ADPCM decoder 1630, wherein a received speech signal r is generated. The quality parameter q is taken in to the ADPCM decoder 1630 so as to enable resetting of the state of the decoder when the quality of the received radio signal $RF_R$ is excessively low. The signals r and q are used by the signal reconstruction unit 240 to generate a reconstructed speech signal $r_{rec}$ in accordance with the proposed method.

A transmitted speech signal S is encoded in an ADPCM encoder 1640, the output signal of which is an ADPCM encoded baseband signal $B_T$. The signal $B_T$ is then modulated in a modulator 1650, wherein an intermediate frequency signal $IF_T$ is generated. The signal $IF_T$ is radio frequency modulated and amplified in a radio transmitter 1660, from which a radio signal $RF_T$ is delivered for transmission to an antenna unit.

Naturally, the ADPCM decoder 1630 and the ADPCM encoder 1640 may be comprised of a logarithmic PCM decoder and logarithmic PCM encoder respectively when this form of speech coding is applied in the system in which the transmitter/receiver unit 1600 operate.

What is claimed is:

1. A method of reconstructing a speech signal from a received signal (r), characterized by creating through a signal model (500) an estimated signal (p) that corresponds to anticipated future values of the received signal (r); generating a quality parameter (q) based on quality characteristics of said received signal (r); combining said received signal (r) and said estimated signal ($\rho$) and forming a reconstructed speech signal ($r_{rec}$), wherein said quality parameter (q) determines weighting factors (α,β) based upon which said respective received signal (r) and said estimated signal (ρ) are combined.

2. A method according to claim 1, wherein the quality parameter is based on a measured power level of the received signal.

3. A method according to claim 1, wherein the quality parameter is based on an estimated received signal level of said received signal in proportion to the signal level of a disturbance signal.

4. A method according to claim 1, wherein said quality parameter is based on a bit error rate that has been calculated from a digital representation of said received signal.

5. A method according to claim 1, wherein said quality parameter is based on a bad frame indicator that has been calculated from a digital representation of said received signal.

6. A method according to claim 1, wherein said signal model is based on a linear prediction of said received signal.

7. A method according to claim 6, wherein said linear prediction generates coefficients that denote a short-term prediction of said received signal.

8. A method according to claim 6, wherein said linear prediction generates coefficients that denote a long-term prediction of said received signal.

9. A method according to claim 6, wherein said linear prediction generates amplification values that relate to a history of said estimated signal.

10. A method according to claim 6, wherein said linear prediction includes information as to whether the received signal shall be assumed to represent speech information or to represent non-speech information.

11. A method according to claim 6 wherein said linear prediction includes information as to whether said received signal shall be assumed to represent a voice sound or to represent a non-voice sound.

12. A method according to claim 6, wherein said linear prediction contains information as to whether said received signal shall be assumed to be locally stationary or locally transient.

13. A method according to claim 1, wherein said received signal is a sampled and quantized analog modulated transmitted speech signal.

14. A method according to claim 1, wherein said received signal is a digitally modulated transmitted encoded signal.

15. A method according to claim 1, wherein said received signal is generated by decoding an adaptive differential pulse code modulated signal.

16. A method according to claim 1, wherein said received signal is generated by encoding a pulse code modulated signal.

17. A method according to claim 1, wherein a transition from solely said received signal to solely said estimated signal takes place during a transition period of at least a predetermined number of consecutive samples of said received signal during which the quality parameter for said received signal is below a predetermined quality value.

18. A method according to claim 1, wherein a transition from solely said estimated signal to solely said received signal takes place during a transition period of at least a predetermined number of consecutive samples of said received signal during which the quality parameter for said received signal exceeds a predetermined quality value.

19. A method according to claim 1, wherein the duration of said transition period is decided by a predetermined variable transition value.

20. An arrangement for reconstructing a speech signal from a received signal (r) and including a signal modeling unit (500), characterized in that the signal modeling unit (500) functions to create an estimated signal (ρ) corresponding to anticipated future values of said received signal (r); in that the arrangement generates a quality parameter (q) based on a quality characteristics of said received signal (r) and includes a signal combining unit (700) which functions to combine said received signal (r) and said estimated signal (ρ), therewith to form a reconstructed speech signal ($r_{rec}$), wherein the quality parameter (q) is processed to generate weighing factors (α,β) based upon which said respective received signal (r) and said estimated signal (ρ) are combined.

21. An arrangement according to claim 20, wherein a processor in said signal combining unit delivers a first weighting factor and a second weighting factor on the basis of the value of said quality parameter for each sample of said received signal.

22. An arrangement according to claim 21, wherein the signal combining unit functions to form a first weighted value of said received signal by multiplying said received signal with said first weighting factor in a first multiplier unit, and to form a second weighted value of said estimated signal by multiplying said estimated signal with said second weighting factor in a second multiplier unit, wherein the first and the second weighted values according to said ratio, are combined in a first summation, and wherein said reconstructed signal is formed as a first summation signal.

23. An arrangement according to claim 22, wherein a transition value stored in said processor denotes a smallest number of consecutive samples of said received signal during which said first weighting factor can be decreased incrementally from a highest value to a lowest value, and said second weighting factor can be increased incrementally from a lowest value to a highest value.

24. An arrangement according to claim 23, wherein said highest value is equal to one; said lowest value is equal to zero; and a sum of said first weighting factor and said second weighting factor is equal to one.

25. An arrangement according to claim 22, wherein a transition value stored in said processor denotes a smallest number of consecutive samples of said received signal during which said first weighting factor can be increased incrementally from a lowest value to a highest value, and said second weighting factor can be decreased incrementally from a highest value to a lowest value.

26. An arrangement according to claim 20, wherein said signal modelling unit includes an analyzing unit which creates, in accordance with a linear predictive signal model, parameters that depend on properties of said received signal.

27. An arrangement according to claim 26, wherein said parameters include filter coefficients of a first digital filter and of a second digital filter whose respective filter transfer functions are inverses of each other.

28. An arrangement according to claim 27, wherein the first digital filter is an inverse filter; and the second digital filter is a synthesis filter.

29. An arrangement according to claim 27, wherein said first digital filter functions to filter said received signal, thereby generating a residual signal.

30. An arrangement according to claim 29, wherein said signal modelling unit includes an excitation generating unit that functions to generate an estimated signal that is based on three of said linear predictive signal mode parameters and a second summation signal, and includes a state machine that functions to generate control signals that are based on said quality parameter and on one of said linear predictive signal mode parameters.

31. An arrangement according to claim 30, wherein said signal modelling unit includes a second summation unit that functions to combine a third weighted value of said residual signal with a fourth weighted value, thereby generating the second summation signal.

32. An arrangement according to claim 31, wherein said second digital filter functions to filter said second summation signal, thereby generating the estimated signal.

33. An arrangement according to claim 31, wherein said excitation generating unit includes a memory buffer and a random signal generator.

34. An arrangement according to claim 33, wherein said memory buffer functions to store the historic values, of said second summation signal.

35. An arrangement according to claim 34, wherein said memory buffer functions to generate, on the basis of two of said linear predictive signal model parameters, a first signal that represents a voice speech sound.

36. An arrangement according to claim 35, wherein said random signal generator functions to generate, on the basis of said control signals, a second signal that represents a non-voice speech sound.

37. An arrangement according to claim 36, further comprising a third summation unit which functions to combine a third weight value of said first signal with a fourth weight value of said second signal, thereby forming said estimated signal.

38. An arrangement according to claim 20, wherein the signal modelling unit includes a first digital filter and a second digital filter whose respective transfer functions are inverse of each other.

39. An arrangement according to claim 38, wherein the first digital filter (510) has the character of a high-pass filter; and in that the second digital filter (580) has the character of a low-pass filter.

40. An arrangement according to claim 20, wherein said received signal is a sampled and quantized analog transmitted speech signal.

41. An arrangement according to claim 20, wherein said received signal is a digitally modulated transmitted encoded.

42. An arrangement according to claim 41, wherein said received signal is generated by decoding an adaptive differential pulse code modulated signal.

43. An arrangement according to claim 41, wherein said received signal is generated by decoding a logarithmic pulse code modulated signal.

* * * * *